US005803595A

United States Patent [19]

Verspaget et al.

[11] Patent Number: 5,803,595

[45] Date of Patent: Sep. 8, 1998

[54] LUMINAIRE

[75] Inventors: Godefridus N. M. Verspaget; Hendrikus A. M. Van Dulmen, both of Eindhoven, Netherlands

[73] Assignee: U.S. Philips Corporation, New York, N.Y.

[21] Appl. No.: 873,390

[22] Filed: Jun. 12, 1997

[30] Foreign Application Priority Data

Jun. 12, 1996 [EP] European Pat. Off. ..... 96201638

[51] Int. Cl.[6] ..... F21S 3/00

[52] U.S. Cl. ..... 362/374; 362/217; 362/220; 362/390; 439/233

[58] Field of Search ..... 362/217, 220, 362/221, 222, 226, 296, 374, 375, 390; 439/232, 233, 239, 409, 410, 656, 698, 725, 729, 835, 864

[56] References Cited

U.S. PATENT DOCUMENTS

| | | | |
|---|---|---|---|
| 2,350,600 | 6/1944 | Foster | 439/232 |
| 2,945,202 | 7/1960 | Roney et al. | 439/232 |
| 2,988,634 | 6/1961 | Miskella | 439/239 |
| 3,141,719 | 7/1964 | Moore | 362/217 |
| 3,321,615 | 5/1967 | Hilzen | 362/217 |
| 3,328,574 | 6/1967 | Linse et al. | 362/217 |
| 4,128,862 | 12/1978 | Thompson | 362/217 |
| 5,073,846 | 12/1991 | Lin | 362/263 |
| 5,169,227 | 12/1992 | Korte et al. | 362/226 |
| 5,461,554 | 10/1995 | Leonetti et al. | 362/390 |
| 5,519,594 | 5/1996 | Wu | 362/226 |
| 5,586,015 | 12/1996 | Baldwin et al. | 362/374 |
| 5,729,080 | 3/1998 | Verspaget et al. | 313/318.01 |

FOREIGN PATENT DOCUMENTS

| | | | |
|---|---|---|---|
| 0325182A2 | 7/1989 | European Pat. Off. | H01R 33/09 |
| 0434292A2 | 6/1991 | European Pat. Off. | H01K 1/44 |
| 07220518A | 8/1995 | Japan | F21V 19/00 |
| 07254393A | 10/1995 | Japan | H01K 1/46 |
| 2231717 | 11/1990 | United Kingdom | H01K 1/40 |

*Primary Examiner*—Alan Cariaso
*Attorney, Agent, or Firm*—F. Brice Faller

[57] ABSTRACT

A pair of lamp holders (5) and a pair of contact members (20) for mechanically and electrically mounting a double ended electric lamp (50) transversely to the optical axis (4) of reflector means (3) present in the housing (1). The contact members (20) each have a first body (21) with an electric contact (23) and a second body (22) to cooperate to keep a current lead (51) of the electric lamp (50) against the contact (23). The first (21) and the second body (22) have a hinging connection (24) one with the other, and a lock (25) at a distance therefrom for keeping them pressed one against the other. In an embodiment the housing (1) has a door (6) hingingly connected to a major part (1') of the housing. In this embodiment the hinge (24) and the lock (25) of the housing (1) act a the hinge (24) and the lock (25) of the contact members (20). The luminaire provides for an easy, fast and secure electrical connection of a lamp.

7 Claims, 2 Drawing Sheets

LUMINAIRE

BACKGROUND OF THE INVENTION

The invention relates to a luminaire provided with a housing with a light emission window;

reflector means having an optical axis which passes through the light emission window, which means are arranged in the housing for directing light generated in the housing through the light emission window to the exterior;

a pair of lampholders in the housing for mechanically mounting a double-ended electric lamp transversely to the optical axis between the reflector means and the light emission window;

a pair of electrical contact members at a distance from the lampholders for connecting respective current conductors of the electric lamp to a supply source, which contact members each comprise a first body with an electrical contact and a second body for cooperating with the first such that a current conductor of the electric lamp is kept pressed against the electrical contact.

Such a luminaire is known from U.S. Pat. No. 5,461,554.

The known luminaire is designed for an electric lamp having two ends (double-ended lamp) which has a lamp cap around each of its two ends, from which cap an electric cable issues to the exterior as the current conductor of the lamp, provided with a cable tag at its free end. The lampholders each hold a lamp cap. The contact members each comprise an insulator body provided with a threaded pin and a nut screwed thereon. The thread and the nut tightly clamp down on the cable tag.

The housing of the known luminaire has a door opposite the light emission window which is hinged to the remaining part of the housing and which supports a reflector portion, the lampholders, and the contact members, and which can be locked in the closed state.

The known luminaire is designed for an electric lamp of high intensity such as, for example, a high-pressure metal halide discharge lamp which consumes a high power of, for example, 0.5 to 18 kW. Such lamps generate a considerable amount of heat during operation which may lead to comparatively high temperatures in the luminaire.

The known luminaire has the disadvantage that high powers, and accordingly high currents, and high temperatures readily lead to corrosion, which results in high contact resistances. These enhance the heat generation and also involve the risk of the lamp extinguishing. Temperature fluctuations may make the screw connection looser and cause the clamping force on the cable tag to decrease. A disadvantage is also that the initial clamping force on the cable tag is dependent on the individual electrician who inserts the lamp.

A similar disadvantage is found in luminaires in which a cable of the luminaire must be clamped below a nut or screw at the lamp, or in which a metal strip must be clamped to the lamp by means of a nut and a bolt.

EP-A-0,643,258 describes a luminaire for a double-ended electric lamp in which the reflector means extend up to the light emission window and are faceted, so that they are rectangular when viewed axially. The reflector means may be divided and have a first part which extends up to the light emission window and a second part on the optical axis at the side of an accommodated lamp remote from the light emission window. The separation plane between the parts may coincide with the focal plane of the reflector means, and an electric lamp can be accommodated in lampholders in said plane.

A Patent Application of earlier date EP 95 201 819.9 (U.S. Pat. No. 5,729,080) describes a double-ended electric lamp from which a bare current conductor projects at both ends, and necks of the lamp vessel each have a metal mounting member at a distance from the relevant end, each member having reference portions aligned in three directions relative to an electric element of the lamp so as to obtain a predetermined position of the electric element in a luminaire.

SUMMARY OF THE INVENTION

It is an object of the invention to provide a luminaire of the kind which renders possible a fast and satisfactory electrical contacting of an electric lamp and which is of a simple construction.

According to the invention, the first and the second body of each contact member are interconnected by means of a hinged joint, and in that a lock is present at a distance from the hinged joint for keeping the first and the second body forced towards one another.

The hinged joint between the two bodies of the contact members renders possible not only a fast detaching and fastening of a current conductor of an electric lamp, but also a comparatively great contact pressure accompanying a comparatively small force exerted by the lock through the utilization of the lever effect in that the contact between the current conductor and the electrical contact is laid comparatively close to the hinged joint as compared with the lock. A comparatively great contact pressure reduces contact resistances and the corrosion generated thereby.

It is an advantage of the contact members that they can directly contact the current conductor issuing from the lamp to the exterior. An insulated cable at the lamp, and possibly a lamp cap around the cable and the lamp, is unnecessary then. It is also attractive that the electrical connection is achieved simply in that the lock is brought into its operational position once the lamp has been mechanically secured in the luminaire. This is especially the case when the current conductors of the lamp need not be manipulated during this, i.e. when the lampholders and the contact members are arranged substantially in a straight line. The lampholders, which grip the lamp by neck-shaped portions thereof, will then be arranged between the contact members.

Another advantage of the contact members is that they may easily be of a comparatively voluminous construction, if so desired, so that they have a heat sink function. The lock of each contact member may be, for example, a closing bracket such as is used for keeping parts of the housing of a luminaire in the closed state, or a clip. In a special embodiment of the luminaire, the housing has a door which is connected to a larger, fixed portion of the housing by means of a hinged joint, and a lock for keeping said door closed at a distance from said hinged joint, the fixed portion of the housing and the door each supporting one of the two bodies of each of the contact members. This embodiment simplifies the contact members because they do not each require an own hinged joint and an own lock but use the hinged joint and the lock of the housing. Exchanging a lamp is also easier and faster then because no individual locks of the contact members need be operated. If the luminaire has a metal housing, the contact members must be mounted with insulation or the bodies of the contact members must be of insulating material, for example ceramic material such as, for example, ceramic material reinforced with glass fibers or mica. The use of the hinged joint and the lock of the housing represents a considerable simplification of the mould in which the bodies can be manufactured especially in the case of the latter kinds of ceramic bodies. This is because no holes are necessary in the bodies for accommodating hinge pins.

It is favorable when the electrical contact of the first body of each contact and the second body thereof are movable relative to one another against spring pressure, for example, when the electrical contact of the first body of each contact member is displaceable against spring pressure through the second body. This embodiment renders it possible to clamp a lamp having comparatively thin current conductors reliably in the contact members, but also a lamp having comparatively thick current conductors or a lamp whose current conductor has become kinked at the area where it is to be clamped in. The spring force is, for example, a few to a few tens, for example 5 to 15, for example 10 N.

In a favorable embodiment, the first body of each contact member is fastened to the door. More in particular, the lampholders are arranged in line between the contact members. A part, for example an apex part of concave reflector means is also fastened to the door in a favorable modification, between the lampholders. Both the mechanical and the electrical connection of the lamp is realized on the door in that case. Another part of the reflector means may be present in the fixed part of the housing, matching into the part present on the door then when the door is closed. It is favorable when the door is opposite the light emission window.

Preferably, the electrical contact of each contact member is chosen to be made of a corrosion-resistant metal having a comparatively high hardness, for example in the range of 200–600 HV (Vickers hardness) and a comparatively low resistivity $\rho$ of at most 0.8 $\mu\Omega$m. A low resistivity leads to a small heat generation in the contact. A high hardness value prevents a comparatively soft current conductor of a lamp to be contacted from deforming the contact. It is achieved thereby that a next lamp can make contact in the luminaire in the same manner as a previous lamp. A comparatively soft current conductor of a lamp also has the advantage that this conductor can be plastically deformed under the pressure of the contact member, so that an increased contact surface area between the current conductor and the contact is created as compared with the situation of a non-deformed current conductor. In addition, the current conductor shapes itself so as to match the surface of the contact, so that impurities from the air cannot penetrate between them. The contact member does not substantially change its surface quality at operating temperatures of up to approximately 250 ° C., i.e. its contact resistance will not change as time progresses.

It is favorable when the contact is made of an alloy comprising nickel or copper. Examples which may be mentioned with their conductivity $\rho(\mu\Omega m)$ and hardness (HV) values are: CuNi15Sn8: 0.19, 270–370; CuTi4.5: 0.13–0.29, 310–350; NiCu31Fe<1: 0.55, 220; NiCu29Al2.5: 0.61, 250–340; NiMn2: 0.12, 220, for which alloys the additions to the main metal are shown in percents by weight; chromium-nickel steel, X12CrNi17 7: 0.8, 540–600; chromium-nickel steel, X7CrNiAl17 7: 0.8, 500.

The luminaire may be used, directed upwards or downwards, for example, for illuminating sports grounds, industrial estates, facades of buildings, for example towers, etc. The luminaire may accommodate an incandescent lamp, for example a halogen incandescent lamp, or a discharge lamp, for example a high-pressure discharge lamp such as a metal halide lamp. The lamp may have an outer envelope, if so desired.

DESCRIPTION OF THE PREFERRED EMBODIMENTS

Figure 1:
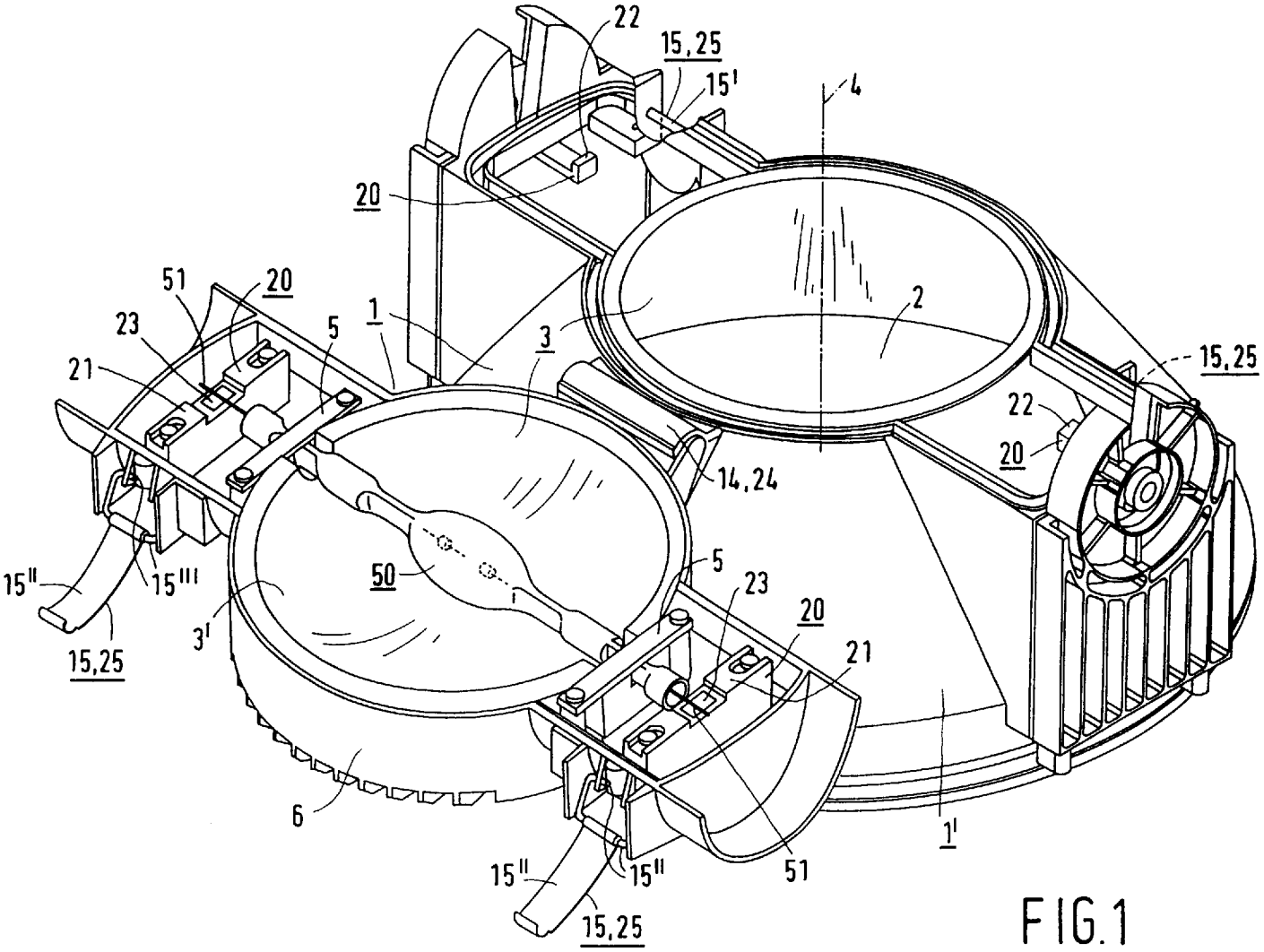
FIG. 1 shows the luminaire with its door opened in perspective view.

In FIG. 1, the luminaire is provided with a housing 1 having a light emission window 2. Reflector 3 has an optical axis 4 which passes through the light emission window 2 are arranged in the housing 1. The reflector 3 has a concave basic shape which directs light generated in the housing 1 by a lamp 50 accommodated therein through the light emission window 2 to the exterior. A pair of lampholders 5 is arranged in the housing for mechanical mounting of the double-ended electric lamp transversely to the optical axis 2 between the reflector 3 and the light emission window 2. A pair of electrical contact members 20 for connecting respective current conductors 51 of the electric lamp 50 to a supply source are present at a distance from the lampholders 5. These contact members 20 each have a first body 21 with an electrical contact 23 and a second body 22 for cooperating with the first body so as to keep respective current conductors 51 of the electric lamp 50 pressed against the electrical contact 23.

The lamp shown is a high-pressure metal halide discharge lamp with a power rating of approximately 1800 W during operation.

The first 21 and the second body 22 of the contact member 20 are interconnected by a hinged joint 24. A lock 25 is present at a distance from the hinged joint 24 for keeping the first 21 and the second body 22 forced towards one another.

In FIG. 1, the housing 1 has a movable part, i.e. a door 6, which is connected to a larger, fixed part 1' of the housing 1 by means of a hinged joint 14, opposite the light emission window 2. A lock 15 is present at a distance from this hinged joint 14 for keeping the door 6 closed, the fixed part 1' of the housing 1 and the door 6 each supporting one body 21, 22 chosen from the first 21 and the second body 22 of each of the contact members 20.

In the Figure, the first body 21 of each contact member 20 carrying the electrical contact 23 is fastened to the door 6, while the second body 22 is fastened to the fixed part 1' of the housing 1. In the luminaire shown, accordingly, the hinged joint 14 between the door 6 and the fixed part 1' of the housing 1 constitutes the hinged joint 24 between the first 21 and the second body 22 of each of the contact members 20. Similarly, the lock 15 between the door 6 and the fixed part 1' of the housing 1 constitutes the lock 25 between the first 21 and the second body 22 of each contact member 20. When the door 6 is closed, the current conductors 51 are caused to lie against the second bodies 22 of the contact members 20, if this had indeed not yet been the case already. When the lock 15 is made operational, the current conductors 51 are clamped in between (the electrical contact 23 of) the first 21 and the second body 22 of each contact member 20 with a predetermined clamping force. This clamping force is accordingly independent of the individual electrician who has inserted the lamp 50.

The lampholders 5 and the contact members 20 are arranged substantially in one straight line. The result of this is that, once the lamp 50 has been mechanically mounted in that it was placed in the lampholders 5, the only operation necessary for allowing the lamp 50 to burn is closing of the door 6. The door 6 in the embodiment shown also supports an apex part 3' of the reflector means 3 between the lampholders 5. The lampholders 5 are arranged between the contact members 20 here.

The lock 15 is of dual design in FIG. 1. This, however, is not essential. The lock 15 is a conventional embracing bracket such as is generally used for luminaires for exterior lighting, but also for other objects such as, for example, tool kits. The lock 15 comprises a projecting part 15' at the fixed part 1' of the housing 1 and an elastic doublehinge clip 15" at the door 6. The clip 15" is hooked around the projecting part 15' and is subsequently forced flat against the door 6 about the two hinges 15"'. The clip passes a position in which it pulls hardest at the fixed part 1' of the housing 1, ending up in a more relaxed position. As a result, the clip 15" cannot make its way back without an outward force.

Figure 2:
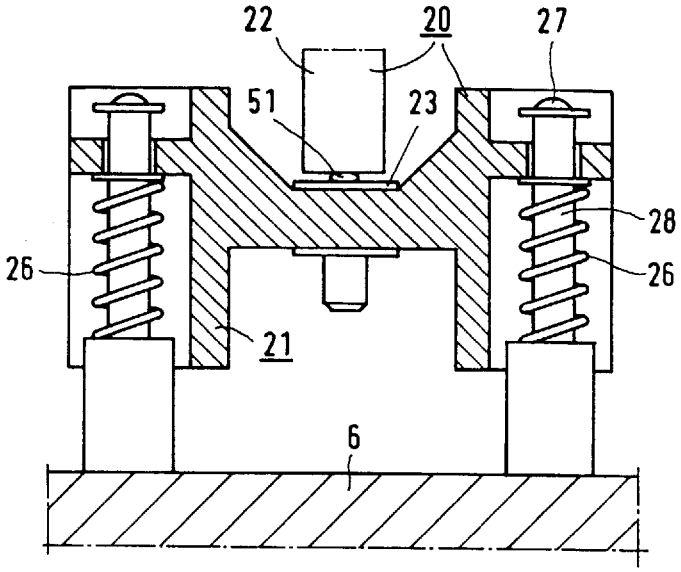
FIG. 2 is a cross-section taken on the line II–II in FIG. 1.

In FIG. 2, the first body 21 of a contact member 20 is fastened to the door 6 with screws 27 which are passed through tubes 28 and retain the latter with clamping force. Springs 26 press against the door 6 at one end and against the first body 21 at the other end. When the second body 22 presses the current conductor 51 against the electrical contact 23 with the door 6 closed, the first body 21 with the contact 23, for example made of NiMn2, and the conductor 51 are displaced towards the door 6 against the force of the springs 26, which springs provide a predetermined clamping force of, for example, approximately 10 N on the current conductor 51. The electrical contact 23 of the first body 21 and the second body 22 are displaceable relative to one another against the pressure of the springs 26. In the Figure, the electrical contact 23 of the first body 21 is displaceable against the pressure of the springs 26 through the second body 22.

Figure 3:
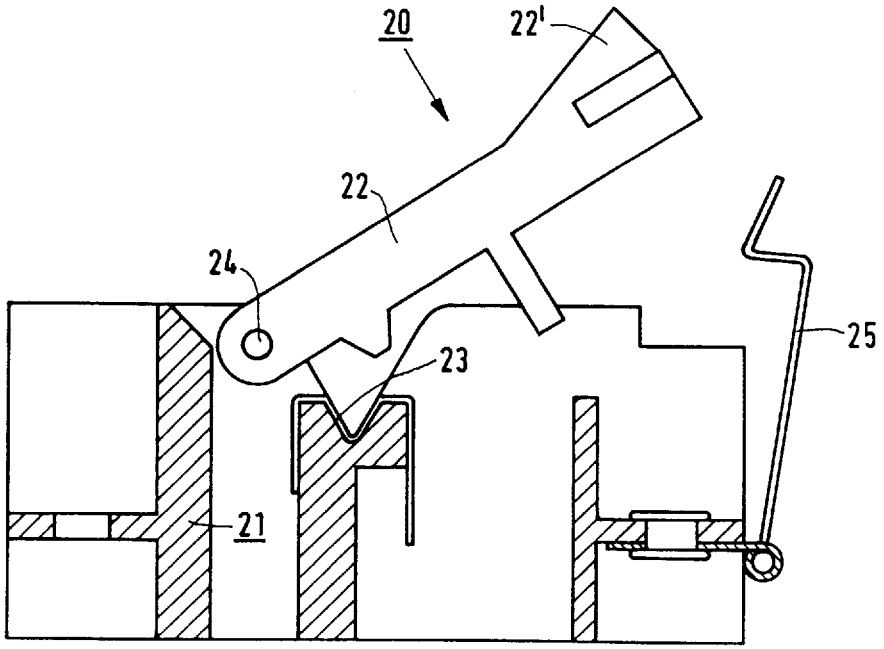
FIG. 3 shows an alternative embodiment of a contact member, partly in cross-section and partly in elevation.

In FIG. 3, the second body 22 of the contact member 20 is permanently fastened to the first body 21 supporting the electrical contact 23 by means of an individual hinged joint 24. The lever formed by the second body 22 about the hinged joint 24 is capable of exerting a comparatively great force of, for example, approximately 10 N on a current conductor placed on the electrical contact 23 as a result of the lock 25 when the latter grips over the free end 22' of the lever.

We claim:

1. A luminaire comprising a housing (1) with a light emission window (2);

reflector means (3) having an optical axis (4) which passes through the light emission window (2), which reflector means (3) are arranged in the housing (1) for directing light generated in the housing (1) through the light emission window (2);

a pair of lampholders (5) in the housing for mechanically mounting a double-ended electric lamp transversely to the optical axis (4) between the reflector means (3) and the light emission window (2);

a double-ended electric lamp mounted in said lampholders;

a pair of electrical contact members (20) at a distance from the lampholders (5) for connecting respective current conductors of the electric lamp to a supply source, which contact members (20) each comprise a first body (21) with an electrical contact (23) and a second body (22) for cooperating with the first such that a current conductor of the electric lamp is kept pressed against the electrical contact (23), a hinged joint (24) interconnecting the first body (21) and the second body (22) of each contact member (20), and a lock (25) spaced from the hinged joint (24) for urging the first body (21) and the second body (22) towards one another.

2. A luminaire as claimed in claim 1, wherein the housing (1) comprises a door (6) and a fixed part (1') connected by a hinged joint (14), and a lock (15) for keeping said door (6) closed at a distance from said hinged joint (14), the fixed part (1') of the housing (1) and the door (6) each supporting one body (21, 22) chosen from the first body (21) and the second (22) body of each of the contact members (20).

3. A luminaire as claimed in claim 1, characterized in that the lampholders (5) and the contact members (20) are arranged substantially in one straight line.

4. A luminaire as claimed in claim 1, characterized in that the electrical contact (23) of the first body (21) and the second body (22) are movable relative to one another against spring (26) pressure.

5. A luminaire as claimed in claim 2, characterized in that the first body (21) is fastened to the door (6).

6. A luminaire as claimed in claim 1, characterized in that the electrical contact (13) is made of a metal alloy having a resistivity $\rho$ of at most 0.8 $\mu\Omega$m and a hardness in the region of 200–600 HV.

7. A luminaire as claimed in claim 4, characterized in that the electrical contact (23) of the first body (21) is displaceable against pressure of spring (26) through the second body (22).

* * * * *